US009567120B2

(12) United States Patent
Spivey, Sr. et al.

(10) Patent No.: US 9,567,120 B2
(45) Date of Patent: Feb. 14, 2017

(54) CARTON FOR ARTICLES

(71) Applicant: Graphic Packaging International, Inc., Atlanta, GA (US)

(72) Inventors: Raymond R. Spivey, Sr., Mableton, GA (US); Frank N. Moncrief, Acworth, GA (US); Aaron Lee Bates, Kennesaw, GA (US); O'Neal Alexander, Covington, GA (US)

(73) Assignee: Graphic Packaging International, Inc., Atlanta, GA (US)

( * ) Notice: Subject to any disclaimer, the term of this patent is extended or adjusted under 35 U.S.C. 154(b) by 0 days.

(21) Appl. No.: 14/970,863

(22) Filed: Dec. 16, 2015

(65) Prior Publication Data

US 2016/0167829 A1 Jun. 16, 2016

Related U.S. Application Data

(60) Provisional application No. 62/124,362, filed on Dec. 16, 2014.

(51) Int. Cl.
*B65D 5/42* (2006.01)
*B65D 5/54* (2006.01)
(Continued)

(52) U.S. Cl.
CPC ..... *B65B 7/16* (2013.01); *B65D 71/36* (2013.01); *B65D 2571/0045* (2013.01);
(Continued)

(58) Field of Classification Search
CPC ... B65D 5/4208; B65D 5/0027; B65D 5/0236; B65D 5/4266; B65D 5/542; B65D 2571/00759; B65D 2571/00716; B65B 7/169
(Continued)

(56) References Cited

U.S. PATENT DOCUMENTS 2,554,190 A 5/1951 Hennessey
2,605,035 A 7/1952 Williamson
(Continued)

FOREIGN PATENT DOCUMENTS

BE 671 762 3/1966
CA 2 172 379 12/1995
(Continued)

OTHER PUBLICATIONS

International Search Report and Written Opinion for PCT/US2015/066005 dated Mar. 28, 2016.

*Primary Examiner* — Christopher Demeree
(74) *Attorney, Agent, or Firm* — Womble Carlyle Sandridge & Rice, LLP

(57) ABSTRACT

A carton for containing a plurality of articles. The carton can comprise a plurality of panels that extends at least partially around an interior of the carton. The plurality of panels can comprise at least a bottom panel, a top panel, and a side panel. At least one end flap can comprise at least a bottom end flap foldably attached to the bottom panel at an end of the carton. The end can have an opening adjacent the bottom end flap. The plurality of articles can be for being disposed in the interior of the carton so that a void is formed in the interior between at least one article of the plurality of articles and at least a portion of the bottom end flap at the end.

49 Claims, 9 Drawing Sheets

(51) Int. Cl.
*B65B 7/16* (2006.01)
*B65D 5/02* (2006.01)
*B65D 71/36* (2006.01)

(52) U.S. Cl.
CPC ..... *B65D 2571/0066* (2013.01); *B65D 2571/00141* (2013.01); *B65D 2571/00456* (2013.01); *B65D 2571/00561* (2013.01); *B65D 2571/00722* (2013.01)

(58) Field of Classification Search
USPC ..... 229/117.16, 103.2; 206/434, 155, 429
See application file for complete search history.

(56) References Cited

U.S. PATENT DOCUMENTS 2,756,553 A 7/1956 Ferguson
2,783,690 A 3/1957 Crary et al.
2,796,709 A 6/1957 Bolding
2,798,603 A 7/1957 Grinspoon
2,849,111 A 8/1958 Fielding
2,854,183 A 9/1958 Srofe
RE24,667 E 7/1959 Fielding
2,922,561 A 1/1960 Currivan
2,928,541 A 3/1960 Fielding
2,929,497 A 3/1960 De Million-Czarnecki
2,974,848 A 3/1961 Fielding
3,060,659 A 10/1962 Blais
3,080,050 A 3/1963 Fielding
3,176,902 A 4/1965 Champlin
3,178,242 A 4/1965 Ellis
3,237,762 A 3/1966 Wood
3,252,649 A 5/1966 Graser et al.
3,300,115 A 1/1967 Schauer
3,306,519 A 2/1967 Wood
3,339,723 A 9/1967 Wood
3,343,660 A 9/1967 Bailey
3,356,279 A 12/1967 Root
3,356,283 A 12/1967 Champlin
3,373,867 A 3/1968 Wood
3,429,496 A 2/1969 Hickin
3,447,672 A 6/1969 Bailey et al.
3,517,858 A 6/1970 Farquhar
3,541,757 A 11/1970 Bertrand
3,557,521 A 1/1971 Pierce, Jr.
3,593,849 A 7/1971 Helms
3,635,452 A 1/1972 Helms
3,669,342 A 6/1972 Funkhouser
3,669,343 A 6/1972 Howard
3,688,972 A 9/1972 Mahon
3,747,835 A 7/1973 Graser
3,767,042 A 10/1973 Ganz
3,807,624 A 4/1974 Funkhouser
3,894,681 A 7/1975 Arneson et al.
3,904,036 A 9/1975 Forrer
3,963,121 A 6/1976 Kipp
4,004,500 A 1/1977 Wood
4,010,593 A 3/1977 Graham
4,096,985 A 6/1978 Wood
4,101,069 A 7/1978 Wood
4,200,220 A 4/1980 Ganz
4,202,446 A 5/1980 Sutherland
4,215,781 A * 8/1980 Humphries ..... B65D 71/16 206/434
4,328,893 A 5/1982 Oliff et al.
4,394,903 A 7/1983 Bakx
4,421,232 A 12/1983 Konaka
4,424,901 A 1/1984 Lanier
4,440,340 A 4/1984 Bakx
4,482,090 A 11/1984 Milliens
4,508,258 A 4/1985 Graser
4,519,182 A 5/1985 Lever et al.
4,523,676 A 6/1985 Barrash
4,566,593 A 1/1986 Muller
4,735,315 A 4/1988 Oliff et al.
4,747,485 A 5/1988 Chaussadas
4,747,487 A 5/1988 Wood
4,784,266 A 11/1988 Chaussadas
4,804,089 A 2/1989 Wilson
4,860,943 A 8/1989 Cooper
4,875,585 A 10/1989 Kadleck et al.
4,901,849 A 2/1990 Wilson
4,919,266 A 4/1990 McIntosh et al.
4,966,324 A 10/1990 Steel
4,972,991 A 11/1990 Schuster
5,000,313 A 3/1991 Oliff
5,042,660 A 8/1991 Carver
5,060,792 A 10/1991 Oliff
5,094,347 A 3/1992 Schuster
5,107,986 A 4/1992 Cooper
5,131,588 A 7/1992 Oliff
5,180,100 A 1/1993 Shimizu
5,195,676 A 3/1993 LeBras
5,197,656 A 3/1993 Hoell et al.
5,246,112 A 9/1993 Stout et al.
5,297,673 A 3/1994 Sutherland
5,351,878 A 10/1994 Cooper
5,395,043 A 3/1995 Bacques et al.
5,421,458 A 6/1995 Campbell
5,443,203 A 8/1995 Sutherland
5,472,090 A 12/1995 Sutherland
5,472,138 A 12/1995 Ingram
5,485,915 A 1/1996 Harris
5,505,372 A 4/1996 Edson et al.
5,542,536 A 8/1996 Sutherland
5,551,556 A 9/1996 Sutherland
5,558,212 A 9/1996 Sutherland
5,558,213 A 9/1996 Sutherland
5,597,071 A 1/1997 Sutherland
5,609,251 A 3/1997 Harris
5,664,401 A 9/1997 Portrait et al.
5,682,995 A 11/1997 Sutherland
5,692,614 A 12/1997 Harris
5,704,542 A 1/1998 Harrelson
5,765,685 A 6/1998 Roosa
5,778,630 A 7/1998 Portrait et al.
5,782,343 A 7/1998 Harrelson
5,853,088 A 12/1998 Saulas et al.
5,855,318 A 1/1999 Baxter
5,931,300 A 8/1999 Sutherland
5,937,620 A 8/1999 Chalendar
5,941,453 A 8/1999 Oliff
5,943,847 A 8/1999 Chalendar
5,947,367 A 9/1999 Miller et al.
5,975,286 A 11/1999 Oliff
6,019,220 A 2/2000 Sutherland
6,021,898 A 2/2000 Sutherland
6,021,899 A 2/2000 Sutherland
6,085,969 A 7/2000 Burgoyne
6,109,438 A 8/2000 Sutherland
6,155,480 A 12/2000 Botsford et al.
6,158,586 A 12/2000 Muller
6,227,367 B1 5/2001 Harrelson et al.
6,241,083 B1 6/2001 Harrelson
6,283,293 B1 9/2001 Lingamfelter
6,289,651 B1 9/2001 Le Bras
6,315,123 B1 11/2001 Ikeda
6,378,697 B1 4/2002 Sutherland et al.
6,378,765 B1 4/2002 Sutherland
6,550,616 B2 4/2003 Le Bras
6,789,673 B2 9/2004 Lingamfelter
6,811,525 B2 11/2004 Culpepper
6,866,185 B2 3/2005 Harrelson
6,948,651 B2 9/2005 Ikeda
6,981,631 B2 1/2006 Fogle et al.
6,988,617 B2 1/2006 Gomes et al.
7,007,800 B2 3/2006 Le Bras
7,025,197 B2 4/2006 Sutherland
7,048,113 B2 5/2006 Gomes
7,159,759 B2 1/2007 Sutherland
7,175,020 B2 2/2007 Sutherland et al.
7,427,010 B2 9/2008 Sutherland
7,448,492 B2 11/2008 Sutherland
7,644,817 B2 1/2010 Sutherland

(56) References Cited

U.S. PATENT DOCUMENTS

| | | | |
|---|---|---|---|
| 7,677,387 | B2 | 3/2010 | Brand et al. |
| 7,762,395 | B2 | 7/2010 | Sutherland et al. |
| 7,762,397 | B2 | 7/2010 | Coltri-Johnson et al. |
| 7,900,815 | B2 * | 3/2011 | Shmagin ..... B65D 71/20 206/139 |
| 7,913,844 | B2 | 3/2011 | Spivey, Sr. |
| 8,347,591 | B2 | 1/2013 | Coltri-Johnson |
| 8,376,213 | B2 | 2/2013 | Brand |
| 2003/0000182 | A1 | 1/2003 | Portrait et al. |
| 2003/0132130 | A1 | 7/2003 | Bras |
| 2004/0000582 | A1 | 1/2004 | Sutherland |
| 2004/0011674 | A1 | 1/2004 | Theelen |
| 2004/0069659 | A1 | 4/2004 | Sutherland |
| 2004/0089671 | A1 | 5/2004 | Miller |
| 2004/0099542 | A1 | 5/2004 | Sutherland |
| 2004/0188277 | A1 | 9/2004 | Auclair |
| 2004/0188301 | A1 | 9/2004 | Gomes |
| 2004/0243277 | A1 | 12/2004 | Bonnain et al. |
| 2004/0254666 | A1 | 12/2004 | Bonnain et al. |
| 2005/0001020 | A1 | 1/2005 | Garnier |
| 2005/0103652 | A1 | 5/2005 | Wilkins |
| 2005/0167290 | A1 | 8/2005 | Sutherland |
| 2005/0178791 | A1 | 8/2005 | Miller |
| 2005/0194430 | A1 | 9/2005 | Auclair et al. |
| 2006/0157545 | A1 | 7/2006 | Auclair |
| 2006/0191811 | A1 | 8/2006 | Fogle et al. |
| 2006/0255108 | A1 | 11/2006 | Shmagin |
| 2007/0017829 | A1 | 1/2007 | Sutherland |
| 2007/0158226 | A1 | 7/2007 | Coltri-Johnson et al. |
| 2007/0227927 | A1 | 10/2007 | Coltri-Johnson |
| 2007/0241017 | A1 | 10/2007 | Sutherland et al. |
| 2010/0072267 | A1 | 3/2010 | May et al. |
| 2011/0131926 | A1 | 6/2011 | Coltri-Johnson |
| 2012/0091190 | A1 | 4/2012 | Smalley et al. |
| 2013/0264379 | A1 | 10/2013 | Schemmel et al. |

FOREIGN PATENT DOCUMENTS

| | | |
|---|---|---|
| CA | 2 542 350 | 5/2005 |
| DE | 91 04 905.9 | 6/1991 |
| DE | 92 03 858.1 | 5/1992 |
| EP | 0 459 658 | 12/1991 |
| EP | 0 509 749 | 10/1992 |
| EP | 0 520 411 | 12/1992 |
| FR | 2 698 074 | 5/1994 |
| JP | 41-18199 | 10/1941 |
| JP | 5-112373 | 5/1993 |
| JP | 9507821 | 8/1997 |
| JP | 2003252323 | 9/2003 |
| WO | WO 89-12008 A1 | 12/1989 |
| WO | WO 96/14253 | 5/1996 |
| WO | WO 97/27124 | 7/1997 |
| WO | WO 00/78634 | 12/2000 |
| WO | WO 02/102208 | 12/2002 |
| WO | WO 03/008292 | 1/2003 |
| WO | WO 2004/087507 | 10/2004 |
| WO | WO 2005/042370 | 5/2005 |
| WO | WO 2005/092735 | 10/2005 |
| WO | WO 2007/019000 | 2/2007 |
| WO | WO 2007/126977 | 11/2007 |
| WO | WO 2009/015320 | 1/2009 |
| WO | WO 2014-052514 A2 | 4/2014 |

* cited by examiner

CARTON FOR ARTICLES

CROSS-REFERENCE TO RELATED APPLICATIONS

This application claims the benefit of U.S. Provisional Patent Application No. 62/124,362, filed on Dec. 16, 2014.

INCORPORATION BY REFERENCE

The disclosures of U.S. Provisional Patent Application No. 62/124,362, which was filed on Dec. 16, 2014, and U.S. Provisional Patent Application No. 61/997,147, which was filed on May 22, 2014, are hereby incorporated by reference for all purposes as if presented herein in their entirety.

BACKGROUND OF THE DISCLOSURE

The present disclosure generally relates to cartons for holding beverage containers or other types of articles. More specifically, the present disclosure relates to cartons configured to receive articles in a nested arrangement.

SUMMARY OF THE DISCLOSURE

In general, one aspect of the disclosure is generally directed to a carton for containing a plurality of articles. The carton can comprise a plurality of panels that extends at least partially around an interior of the carton. The plurality of panels can comprise at least a bottom panel, a top panel, and a side panel. At least one end flap can comprise at least a bottom end flap foldably attached to the bottom panel at an end of the carton. The end can have an opening adjacent the bottom end flap. The plurality of articles can be for being disposed in the interior of the carton so that a void is formed in the interior between at least one article of the plurality of articles and at least a portion of the bottom end flap at the end.

In another aspect, the disclosure is generally directed to a blank for forming a carton for containing a plurality of articles. The blank can comprise a plurality of panels comprising at least a bottom panel, a top panel, and a side panel. At least one end flap can comprise at least a bottom end flap foldably attached to the bottom panel. The bottom end flap can be for at least partially forming an end of the carton formed from the blank. The end can be for having an opening adjacent the bottom end flap when the carton is formed from the blank. The plurality of articles can be disposed in the interior of the carton formed from the blank for forming a void in the interior between at least one article of the plurality of articles and at least a portion of the bottom end flap at the end when the carton is formed from the blank.

In another aspect, the disclosure is generally directed to a method of forming a carton for containing a plurality of articles. The method can comprise obtaining a blank comprising a plurality of panels and at least one end flap, the plurality of panels comprising at least a bottom panel, a top panel, and a side panel, and the at least one end flap comprising at least a bottom end flap foldably attached to the bottom panel. The method further can comprise forming an interior of the carton at least partially defined by the plurality of panels, disposing the plurality of articles at least partially in the interior of the carton, and positioning the at least one end flap to partially close an end of the carton. The end can have an opening adjacent the bottom end flap. The disposing the plurality of articles can comprise positioning at least one article of the plurality of articles so that a void is formed between the at least one article and the bottom end flap at the end of the carton after the positioning the at least one end flap.

Those skilled in the art will appreciate the above stated advantages and other advantages and benefits of various additional embodiments reading the following detailed description of the embodiments with reference to the below-listed drawing figures.

According to common practice, the various features of the drawings discussed below are not necessarily drawn to scale. Dimensions of various features and elements in the drawings may be expanded or reduced to more clearly illustrate the embodiments of the disclosure.

BRIEF DESCRIPTION OF THE DRAWINGS

Corresponding parts are designated by corresponding reference numbers throughout the drawings.

DETAILED DESCRIPTION OF THE EXEMPLARY EMBODIMENT

The present disclosure generally relates to cartons that contain articles such as containers, bottles, cans, etc. The articles can be used for packaging food and beverage products, for example. The articles can be made from materials suitable in composition for packaging the particular food or beverage item, and the materials include, but are not limited to, aluminum and/or other metals; glass; plastics such as PET, LDPE, LLDPE, HDPE, PP, PS, PVC, EVOH, and Nylon; and the like, or any combination thereof.

Cartons according to the present disclosure can accommodate articles of any shape. For the purpose of illustration and not for the purpose of limiting the scope of the disclosure, the following detailed description describes beverage containers (e.g., aluminum cans or glass beverage bottles) as disposed within the carton embodiments. In this specification, the terms "inner," "outer," "lower," "bottom," "upper," and "top" indicate orientations determined in relation to fully erected and upright cartons.

Figure 1:
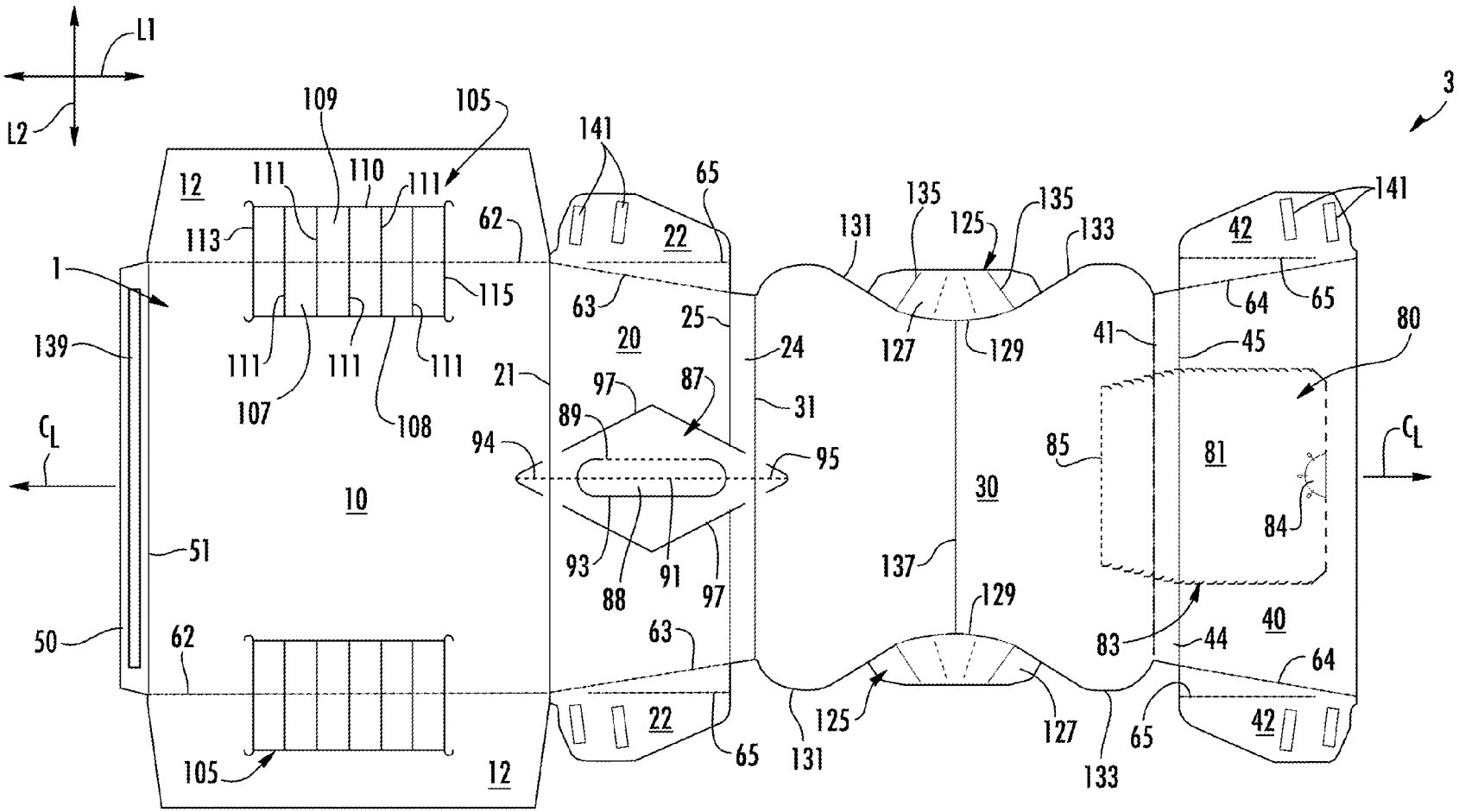
FIG. 1 is an exterior plan view of a blank used to form a carton according to an exemplary embodiment of the disclosure.

FIG. 1 is a plan view of the exterior side 1 of a blank, generally indicated at 3, used to form a carton 5 (FIGS. 3-8) according to one exemplary embodiment of the disclosure. The carton 5 can be used to house a plurality of articles such as containers in the form of beverage cans C to form a package 7 (FIGS. 3-8). In one embodiment, the carton 5 is sized and configured to contain fourteen cans C in a single layer in a "nested" (e.g., an "internal" or "inverted" nested) arrangement having two outer rows R1 of four cans per row and two inner rows R2 of three cans per row as shown schematically with respect to the top and bottom panels of the blank 3 in FIG. 2. Various other container arrangements (e.g., fully nested arrangements, internal nested arrangements, and other arrangements) could be used with the illustrated embodiment, or other illustrated and non-illustrated embodiments of the disclosure. Alternatively the carton 5 could be modified so that the containers C are bottles without departing from the disclosure. In general, the internal nesting arrangements can have one or more interior rows R2 of containers C that are generally shorter than the outer rows R1 of containers. For example, the outer row(s) R1 could have one more container each than the inner row(s) R2 respectively nested with the outer row(s). Exemplary variations could include outer row(s) R1 having five containers and inner row(s) R2 having six containers, outer row(s) R1 having three containers and inner row(s) R2 having two containers, etc. In alternative embodiments, the carton can be sized accordingly to accommodate the arrangement of the containers C whether the containers are cans or bottles. Other suitable nested or non-nested arrangements of the containers C including bottles or cans could be provided without departing from the disclosure. The carton 5 can include features for facilitating conservation of board material when housing the containers C in a nested arrangement.

The blank 3 has a longitudinal axis L1 and a lateral axis L2. In the illustrated embodiment, the blank 3 comprises a bottom panel 10 foldably connected to a first side panel 20 at a first lateral fold line 21, a top panel 30 foldably connected to the first side panel 20 at a second lateral fold line 31, a second side panel 40 foldably connected to the top panel 30 at a third lateral fold line 41, and an attachment flap 50 foldably connected to the bottom panel 10 at a fourth lateral fold line 51. As shown in FIG. 1, each of the side panels 20, 40 can include a respective corner panel 24, 44 adjacent the top panel 30. Each of the corner panels 24, 44 can be at least partially defined by respective lateral fold lines 25, 45, the respective lateral fold lines 31, 41, and respective free edges of the respective side panels 20, 40. In one embodiment, the corner panels 24, 44 can help the side panels 20, 40 at least partially conform to the shape of the containers C in the carton 5. Any of the top and bottom panels 30, 10, the side panels 20, 40, and the corner panels 24, 44 could be omitted or could be otherwise shaped, arranged, positioned, and/or configured without departing from the disclosure. For example, the attachment flap 50 could be foldably connected to the second side panel 40. Additionally, the blank 3 alternatively could include two top panels cooperating to form a top of the carton 5 or two bottom panels cooperating to form a bottom of the carton without departing from the disclosure. Further, the side panels 20, 40 could include bottom corner panels in addition or alternatively to the corner panels 24, 44.

The bottom panel 10 is foldably connected to a bottom end flap 12, the first side panel 20 is foldably connected to a first side end flap 22, and the second side panel 40 is foldably connected to a second side end flap 42. In one embodiment, the bottom end flap 12 and the side end flaps 22, 42 extend along a marginal area of the blank 3. As shown in FIG. 1, the bottom end flap 12 is foldably connected to the bottom panel 10 at a longitudinal fold line 62, the first side end flap 22 is foldably connected to the first side panel 20 at an oblique fold line 63, and the second side end flap 42 is foldably connected to the second side panel 40 at an oblique fold line 64.

Figure 3:
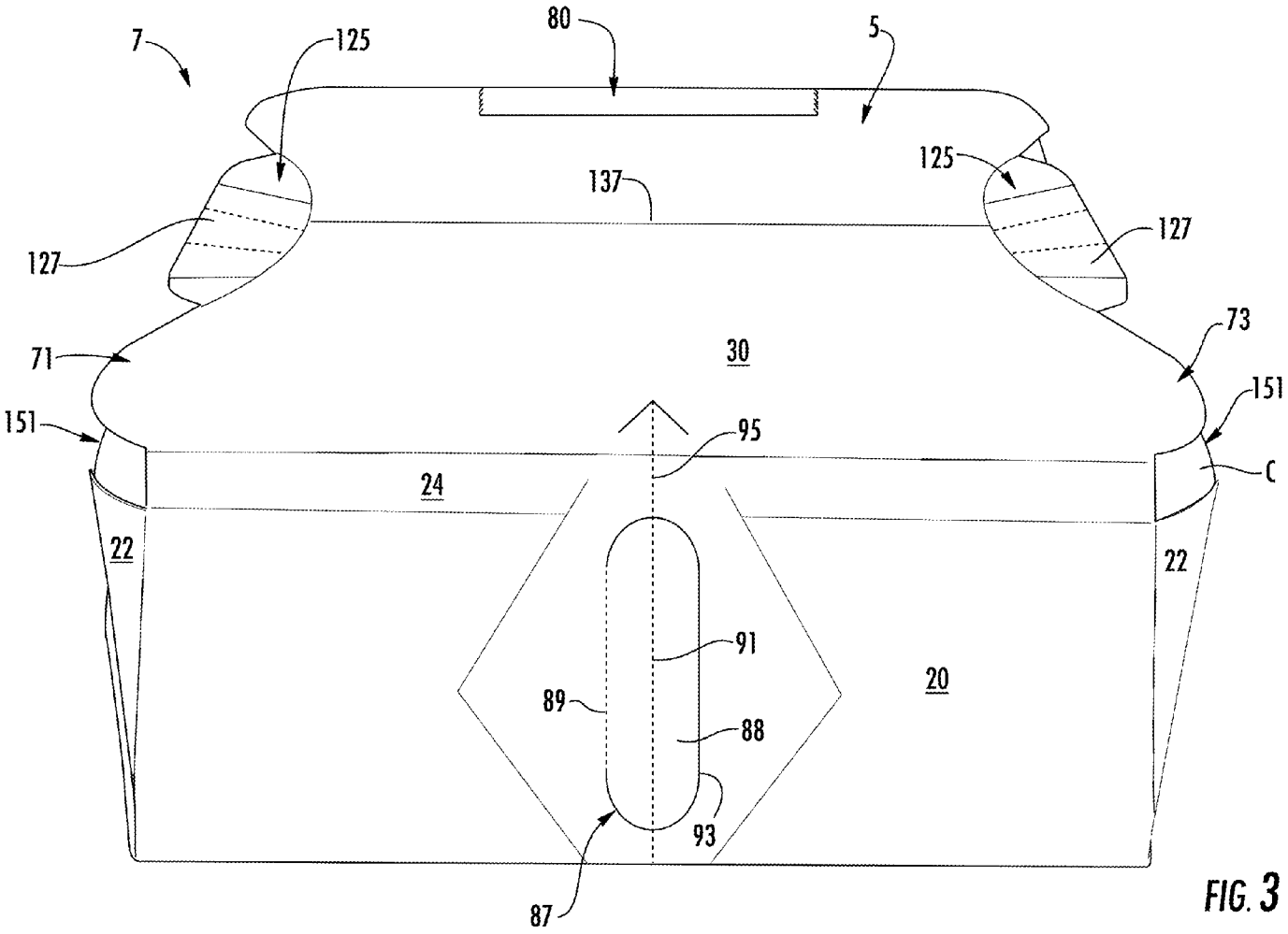
FIGS. 3 and 4 are perspective views of a package including the assembled carton holding containers according to the exemplary embodiment of the disclosure.
Figure 4:
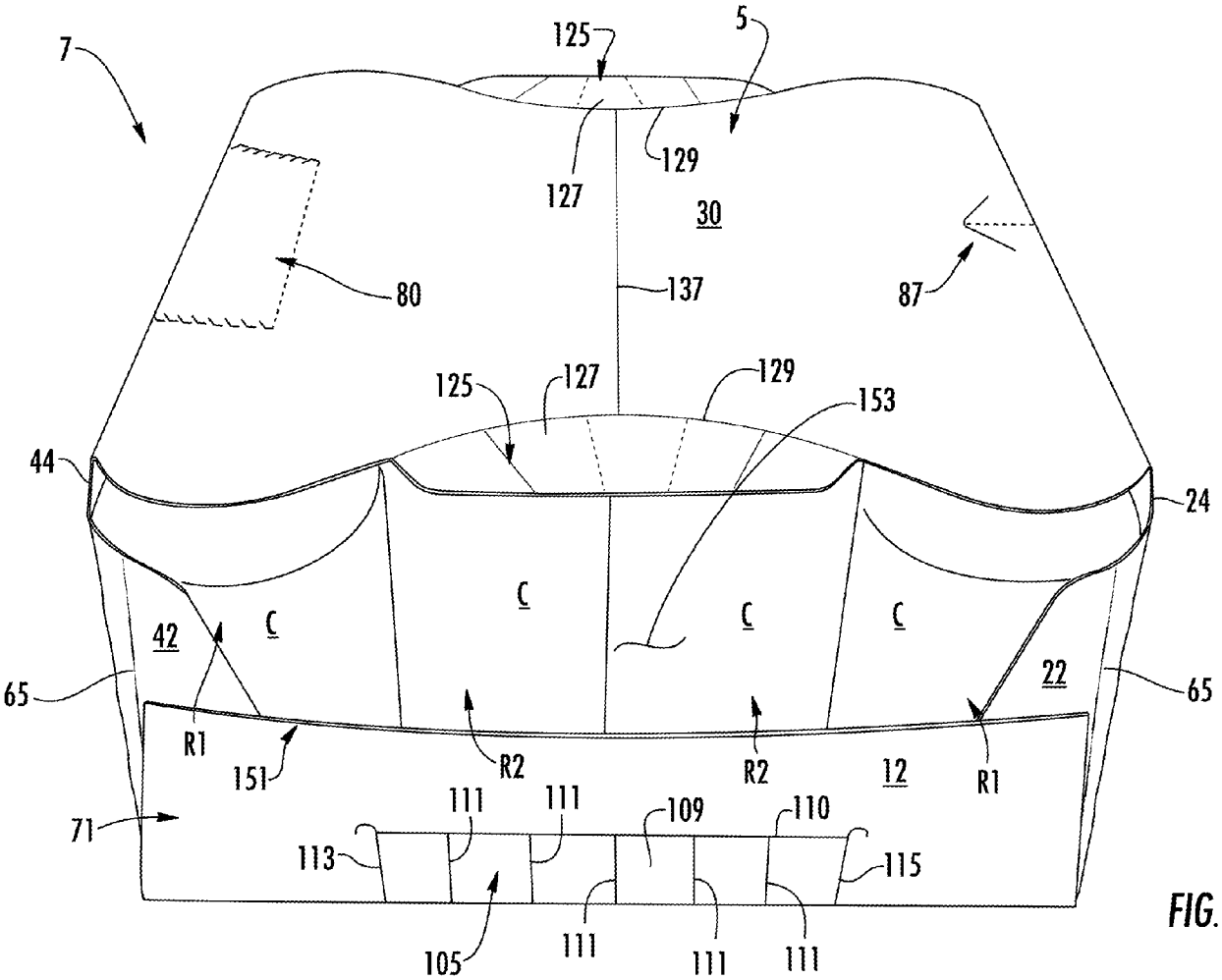
Figure 5:
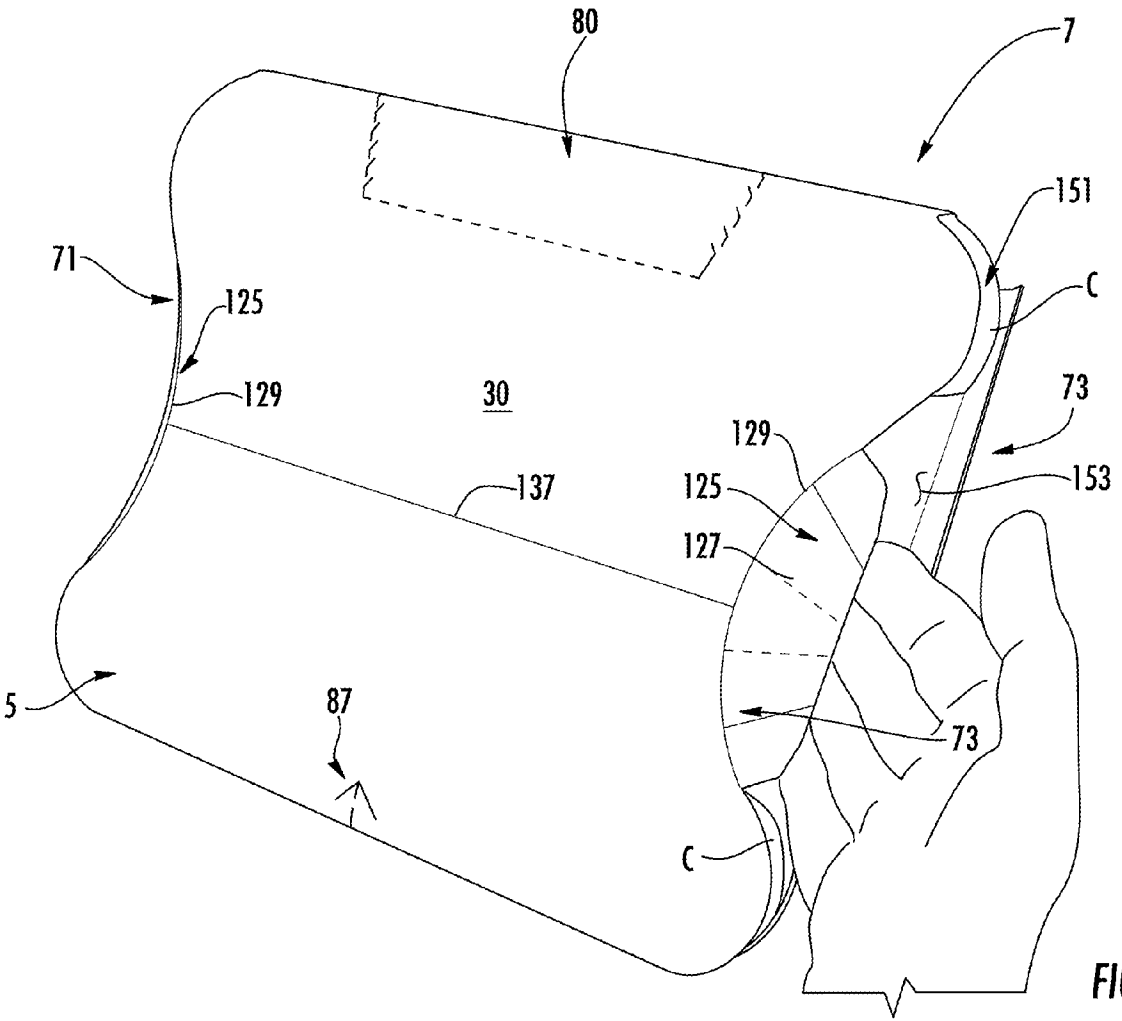
FIGS. 5 and 6 are perspective views of the package of FIGS. 3 and 4 showing the actuation of upper handles.

As shown in FIG. 1, each of the side end flaps 22, 42 includes a secondary fold line 65 that extends from a free edge of the respective side end flap 22, 42. In the illustrated embodiment, the secondary fold line 65 of the side end flap 22 extends in the longitudinal direction L1 toward an intersection with the oblique fold line 63 and the lateral fold line 21 to generally form a wedge between the oblique fold line 63 and the secondary fold line 65. Similarly, the fold line 65 in the side end flap 42 extends in the longitudinal direction L1 toward an intersection with the oblique fold line 64 and a free edge of the side panel 40 to generally form a wedge between the oblique fold line 64 and the secondary fold line 65. As shown in FIG. 1, the secondary fold lines 65 stop short of intersecting the fold lines 63, 64 so that the secondary fold lines 65 are spaced from the respective oblique fold lines 63, 64. In one embodiment, the secondary fold lines 65 can help the side end flaps 22, 42 conform to the shape of the containers C at the corners of the carton 5 (FIGS. 3-5). The end flaps 12, 22, 42 and the fold lines 62, 63, 64, 65 could be otherwise shaped, arranged, and/or configured without departing from the disclosure.

In the illustrated embodiment, the blank 3 is generally a mirror-image about its longitudinal centerline CL such that the end flaps 12, 22, 42 that extend along one marginal area of the blank have similar or identical features at the second marginal area of the blank that are mirror images of the features at the first marginal area of the blank. The end flaps 12, 22, 42 at the first marginal area of the blank are configured to at least partially close a first end 71 (FIGS. 3 and 4) of the carton 5 and the end flaps 12, 22, 42 at the second marginal area of the blank are configured to at least partially close a second end 73 of the carton (FIGS. 3 and 5). One or more of the bottom end flap 12 and/or the side end flaps 22, 42, could be omitted or could be otherwise shaped, arranged, configured, and/or positioned without departing from the disclosure. Additionally, one or both of the ends 71, 73 of the carton could be otherwise shaped, arranged, configured, and/or positioned without departing from the disclosure.

As shown in FIG. 1, the blank 3 can include features for forming a dispenser 80 in the carton 5 including a dispenser panel 81 at least partially separable from the second side panel 40 and the top panel 30 by a tear line 83. In one embodiment, an access feature 84 is in the second side panel 40 for helping to initiate tearing of the tear line 83 to actuate the dispenser 80. As shown in FIG. 1, the dispenser panel 81 can be foldably connected to the top panel 30 at a lateral fold line 85 extending between respective ends of the tear line 83. In alternative embodiments, the lateral fold line 85 is a tear line that allows complete separation and removal of the dispenser panel 81 from the carton 5. The dispenser panel 81, tear line 83, access feature 84, and/or fold line 85 could be otherwise shaped, arranged, positioned, and/or configured without departing from the disclosure. Further, the dispenser 80 and one or more of the features forming the dispenser could be omitted without departing from the disclosure.

In one embodiment, the blank 3 has features for forming a handle 87 in the first side panel 20 of the carton 5. The features in the first side panel 20 can include a handle flap 88 foldably connected to the first side panel 20 at a longitudinal fold line 89. The handle flap 88 can include a longitudinal fold line 91 in the centerline of the flap and can be separable from the side 20 at a cut or tear line 93. In one embodiment, the handle 87 includes two tear lines 94, 95 extending from respective ends of the handle flap 88 and into a respective bottom panel 10 or top panel 30. The handle 87 includes lines of weakening 97 (e.g. creases, fold lines, cut lines, etc.) in one or more of the first side panel 20, bottom panel 10, and top panel 30. The handle 85 could be omitted or could be otherwise shaped, arranged, positioned, and/or configured without departing from the disclosure.

Figure 7:
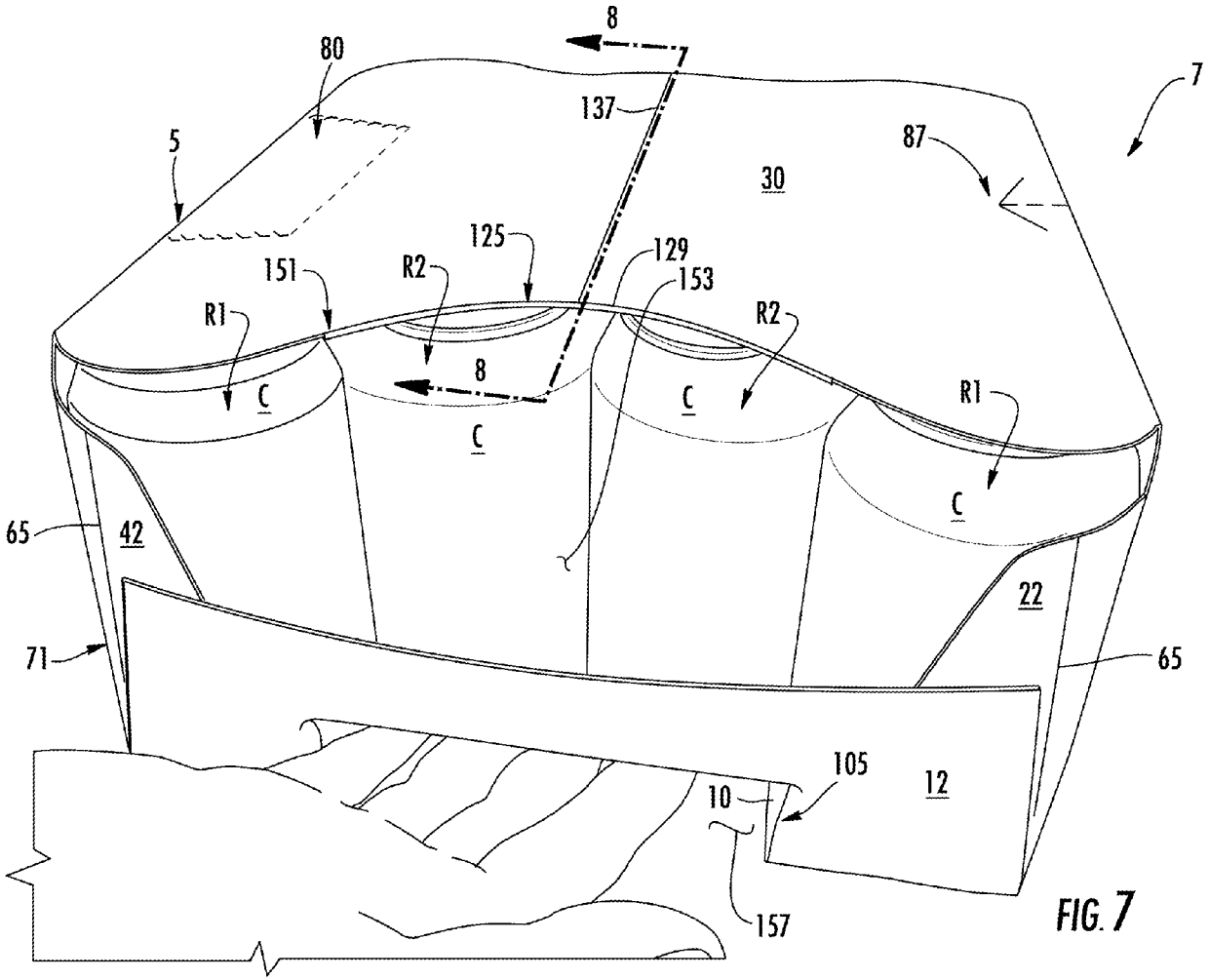
FIG. 7 is a perspective view of the package of FIGS. 3 and 4 showing an actuated lower handle.
Figure 8:
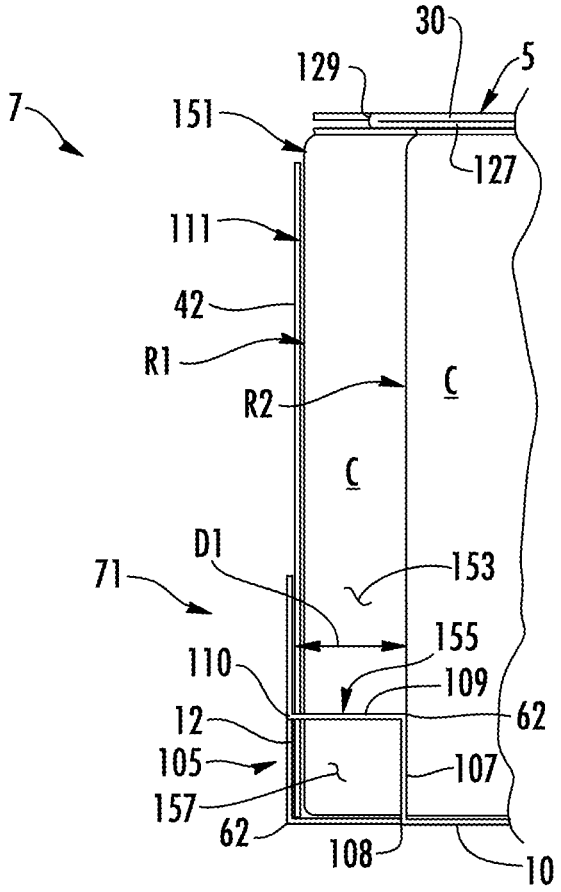
FIG. 8 is a schematic cross-sectional view of the package taken along the line 8-8 in FIG. 7.

As shown in FIG. 1, the blank 3 has features for forming a knee lock or lower handle 105 in each end 71, 73 of the carton 5 (FIGS. 7 and 8). As shown in FIG. 1, the handle features include a first handle panel 107 foldably connected to the bottom panel 10 at a longitudinal fold line 108, and a second handle panel 109 in the bottom end flap 12 foldably connected to the first handle panel 107 by a portion of the longitudinal fold line 62 extending between the handle panels 107, 109 and foldably connected to the bottom end flap 12 at a longitudinal fold line 110. In one embodiment, the handle features include a plurality of lateral fold lines 111 extending across the handle panels 107, 109 between the longitudinal fold lines 108, 110. The handle features include two lateral cuts or tear lines 113, 115 (broadly, "lines of weakening") at respective ends of the handle panels 107, 109 that extend from respective ends of the longitudinal fold line 108 in the bottom panel 10 to respective ends of the longitudinal fold line 110 in the bottom end flap 12. In one embodiment, the tear lines 113, 115 can have hook-shaped ends that can act as tear stops to help prevent undesired tearing of the bottom panel 10 and/or the bottom end flap 12. The features for forming the handle 105 in each end 71, 73 could be omitted or could be otherwise shaped, arranged, positioned, and/or configured without departing from the disclosure.

In the illustrated embodiment, the blank 3 includes features for forming an upper handle 125 in each end 71, 73 of the carton. As shown in FIG. 1, the handle features include a handle flap 127 foldably connected to the top panel 20 at a curved fold line 129. In one embodiment, the top panel 30 has two curved edges 131, 133 extending from respective ends of the curved fold line 129 at each end of the top panel 30. As shown in FIG. 1, with respect to the respective ends 71, 73 of the carton 5, the curved edges 131, 133 are convex curves and the curved fold line 129 is concave. In the illustrated embodiment, each of the handle flaps 127 can have a width (e.g., extending in the lateral direction L2 from the curved fold line 129 to a free edge of the handle flap), wherein the width of the handle flaps 127 extends outwardly from the top panel 30 less than or about the same as the convex curved edges 131, 133. Accordingly, the handle flaps 127 do not extend outwardly from the top panel 30 beyond the edges 131, 133 in a direction that is generally perpendicular to the longitudinal axis CL of the blank 3 in one embodiment. As shown in FIG. 1, the handle flap 127 includes a plurality of oblique fold lines 135 and the top panel 30 includes a lateral fold line 137 extending between the two curved fold lines 129 at respective ends of the top panel. The handle flap 127 and/or the other features for forming the upper handle 125 could be omitted or could be otherwise shaped, arranged, positioned, and/or configured without departing from the disclosure.

In the illustrated embodiment, the carton 5 can be erected by folding the panels 10, 20, 30, 40 along the lateral fold lines 21, 31, 41, 51 and gluing the attachment flap 50 to the second side panel 40 to form an open-ended sleeve (not shown). In one exemplary embodiment, the bottom panel 10 is folded along the lateral fold line 21 over the first side panel 20 and the top panel 30, and then the second side panel 40 is folded along the lateral fold line 41 over the top panel 30. As the second side panel 40 is folded, it can overlap the attachment flap 50 and can be glued to the attachment flap (e.g., by a glue strip 139 as shown in FIG. 1). Subsequently, the panels 10, 20, 30, 40 can be folded along the lateral fold lines 21, 31, 41, 51 to form the open-ended sleeve (not shown), and the containers C can be loaded into the sleeve before or after closing either of the ends 71, 73. The containers C can be arranged in the nested arrangement with the two outer rows R1 and the two inner rows R2 before, after, or during loading of the containers C into the sleeve. In another embodiment, the containers C can be loaded onto the bottom panel 10 and the other panels 20, 30, 40 can be formed or wrapped around the containers to form the open-ended sleeve. Alternatively, the containers can be loaded onto the top panel 30 prior to forming the open-ended sleeve without departing from the disclosure.

One or both of the ends 71, 73 can be at least partially closed by folding the end flaps 12, 22, 42 along the fold lines 62, 63, 64, 65. As shown in FIG. 4, the ends 71, 73 are formed by folding the side end flaps 22 along the fold lines 63, 65 and folding the side end flaps 42 along the fold lines 64, 65 to at least partially conform around the containers C at the respective ends of the respective outer rows R1 and upwardly folding the bottom end flap 12 to overlap the side end flaps 22, 42 at each end. In one embodiment, the bottom end flap 12 can be glued to the side end flaps 22, 42 in multiple locations (e.g., by glue strips 141 on the side end flaps 22, 42 as shown in FIG. 1). Each end 71, 73 includes an opening 151 above the bottom end flap 12 and below the top panel 30 (e.g., the opening 151 can extend between the bottom end flap 12 and the top panel 30). In the illustrated embodiment, the opening 151 can be at least partially defined by portions of respective free edges of the bottom end flap 12, the side end flaps 22, 42, the corner panels 24, 44, the top panel 30, and the handle flap 127 at each end 71, 73. Alternatively, the handle flap 127 could be folded with respect to the top panel 30, and the opening can be at least partially defined by the fold line 129 instead of the free edge of the handle flap 127. The ends 71, 73 could be otherwise formed and/or could be otherwise shaped, arranged, positioned, and/or configured without departing from the disclosure.

In the illustrated embodiment, the containers C are arranged in an internal nested arrangement prior to, during, or after loading of the containers. Since each of the inner rows R2 include one fewer container C than each of the outer rows R1 and each of the inner rows R2 is nested with the respective outer rows R1, the inner rows R2 are spaced apart from each of the ends 71, 73 (and each of the fold lines 62) by a distance D1 (FIGS. 2 and 8), for example. Accordingly, there is a void 153 between the inner rows R2 and each of the closed ends 71, 73 (e.g., the containers C at the ends of the inner rows R2 are spaced from the bottom end flap 12). The voids 153 can provide a space for a user to reach into the interior of the carton 5 at the handles 105, 125 between the ends 71, 73 and the containers C. The containers B could be otherwise loaded into the carton 5 without departing from the disclosure.

Figure 6:
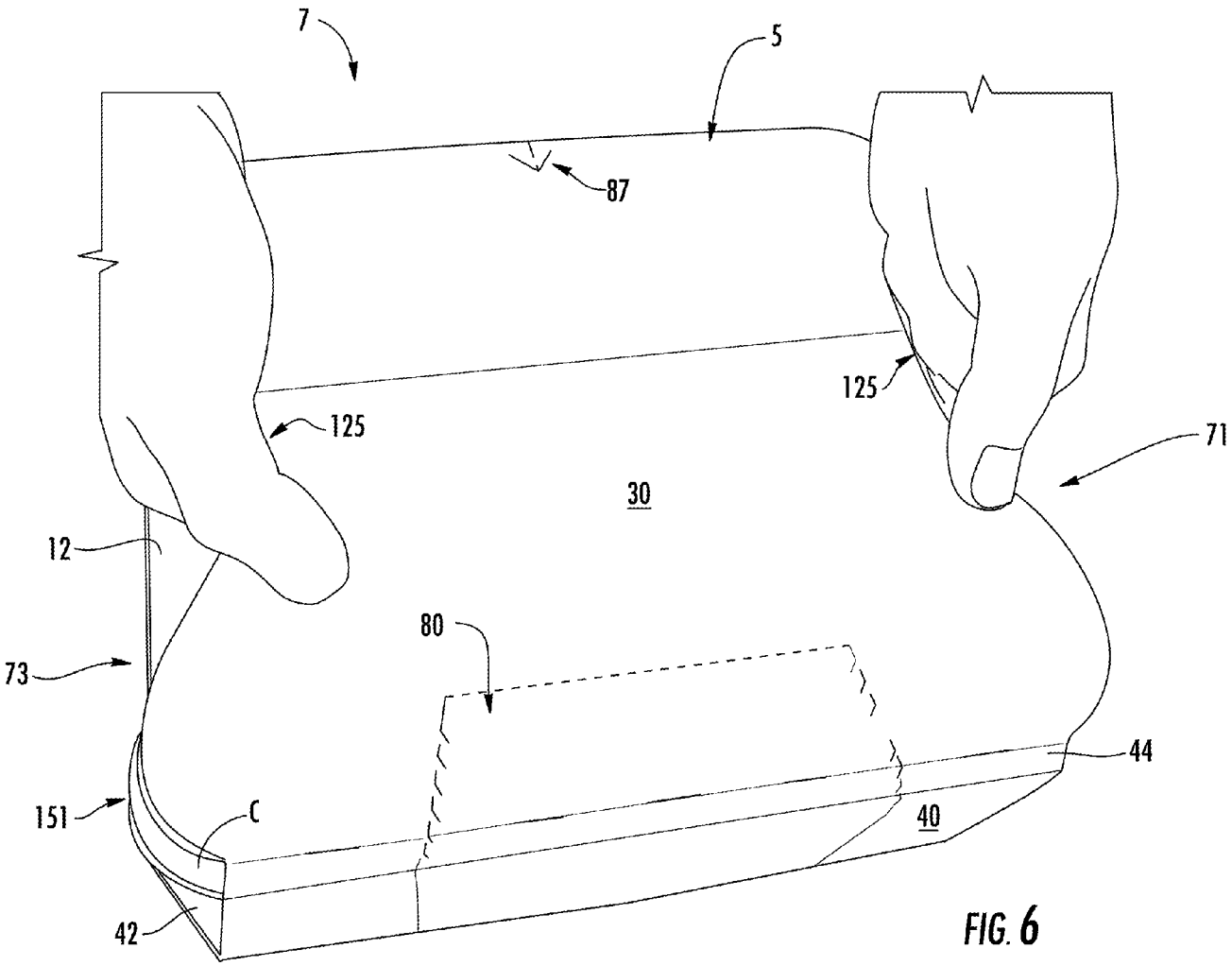

In the illustrated embodiment, the upper handle 125 can be formed at either or both ends 71, 73 of the carton 5. As shown in FIG. 5, the upper handle 125 can be actuated by folding the upper handle flap 127 at the curved fold line 129 so that the handle flap is folded inwardly approximately 180 degrees from the position shown in FIGS. 3 and 4 so that the upper handle flap 127 is face-to-face contact with the interior surface of the top panel 30. Alternatively, the upper handle flap 127 can be folded less than 180 degrees and still be used for grasping the carton 5. In an alternative embodiment, the upper handle flap 127 could be folded during formation of the carton 5 (e.g., prior to forming the open-ended sleeve—not shown, after forming the sleeve and before loading the containers C, etc.). In one embodiment, the upper handle 125 provides reinforcement to the top panel 30 when the carton 5 is grasped and carried at the upper handle (FIG. 6). In addition, the curved fold line 129 and the upper handle flap 127 can provide a more comfortable grip at the upper handle 125 relative to grasping an edge of the top panel 30. The upper handle 125 could be otherwise formed or could be otherwise shaped, arranged, positioned, and/or configured, or could be omitted, without departing from the disclosure.

Figure 2:
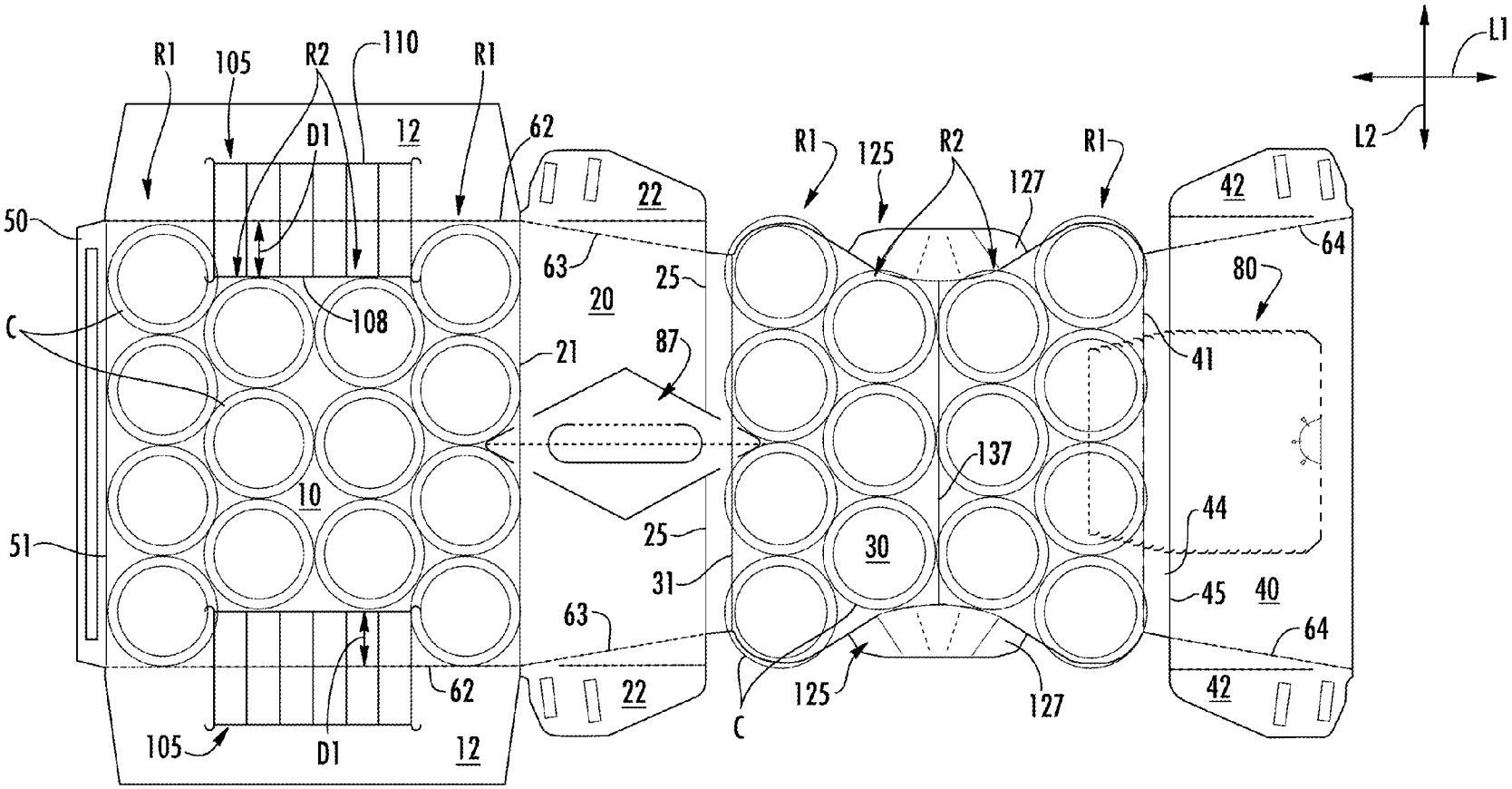
FIG. 2 is a plan view of the blank of FIG. 1 with an arrangement of containers schematically shown with respect to a bottom panel and a top panel according to the exemplary embodiment of the disclosure.

In one embodiment, the bottom handle 105 can be formed at either or both ends 71, 73 of the carton 5. As shown in FIGS. 7 and 8, the bottom handle 105 can be formed by tearing along the tear lines 113, 115 and folding the handle panels 107, 109 inwardly along longitudinal fold lines 62, 108, 110 generally into the void 153 at the respective end 71, 73. Accordingly, the second handle panel 109 can be positioned to extend inwardly generally perpendicular to bottom end flap 12 and generally parallel to the bottom panel 10, and the first handle panel 107 can be positioned to extend upwardly generally perpendicular to the bottom panel 10 and the second handle panel 109 and generally parallel to the bottom end flap 12. In this way, the bottom handle 105 forms a knee lock or shoulder 155 in the respectively adjacent void 153 at the bottom of the carton 5 at one or both of the ends 71, 73 (FIGS. 7 and 8). As shown in FIGS. 2 and 8, the width of the handle panels 107, 109 (e.g., the distance between the fold line 62 and the respective fold lines 108, 110) is approximately equal to the distance D1 between the containers C at the ends of the inner rows R2 and the bottom end flap 12 and the fold line 62. Accordingly, the second handle panel 109 extends substantially the entire distance D1 from the bottom end flap 12 (e.g., at the fold line 110) to the end containers C of the inner rows R2. In one embodiment, the second handle panel 109 can help retain the first handle panel 107 against the end containers C of the inner rows R2, and the shoulder 155 can help retain the containers in the inner rows R2.

As shown in FIGS. 7 and 8, the shoulders 155 in the interior of the carton 5 can form a space or corner void 157 in the exterior of the carton so that at least the bottom end flap 12 and the second handle panel 109 can be grasped at each end 71, 73 to carry the carton. In one embodiment, the corner void 157 can be at least partially defined by the exterior surfaces of the handle panels 107, 109 and the edges of the bottom panel 10 and the bottom end flap 12 formed by the tear lines 113, 115. The bottom handle 105 can be otherwise shaped, arranged, positioned, and/or configured, or could be omitted, without departing from the disclosure.

The carton 5 can also be carried by the handle 87 in the first side panel 20. The handle 87 can be formed by folding the handle flap 88 inwardly at one or both of the fold lines 89, 91 to create a handle opening. The carton can be grasped by the handle opening of the handle 87 in the first side panel. The handle 87 can be otherwise shaped, arranged, positioned, and/or configured, or could be omitted, without departing from the disclosure.

Any of the features of the exemplary embodiment of the disclosure could be omitted or could be included in various combinations without departing from the scope of this disclosure (e.g., the handles 105, 125 could be included with the handle 87 omitted, the handle 105 and the dispenser 80 could be included with the handles 87, 125 omitted, etc.). Further, it is noted that the features of the exemplary embodiment can be incorporated into a carton having any suitable carton style, panel configuration, and/or nesting arrangement. The carton styles, panel configurations, and nesting arrangements described above are included by way of example.

Figure 9:
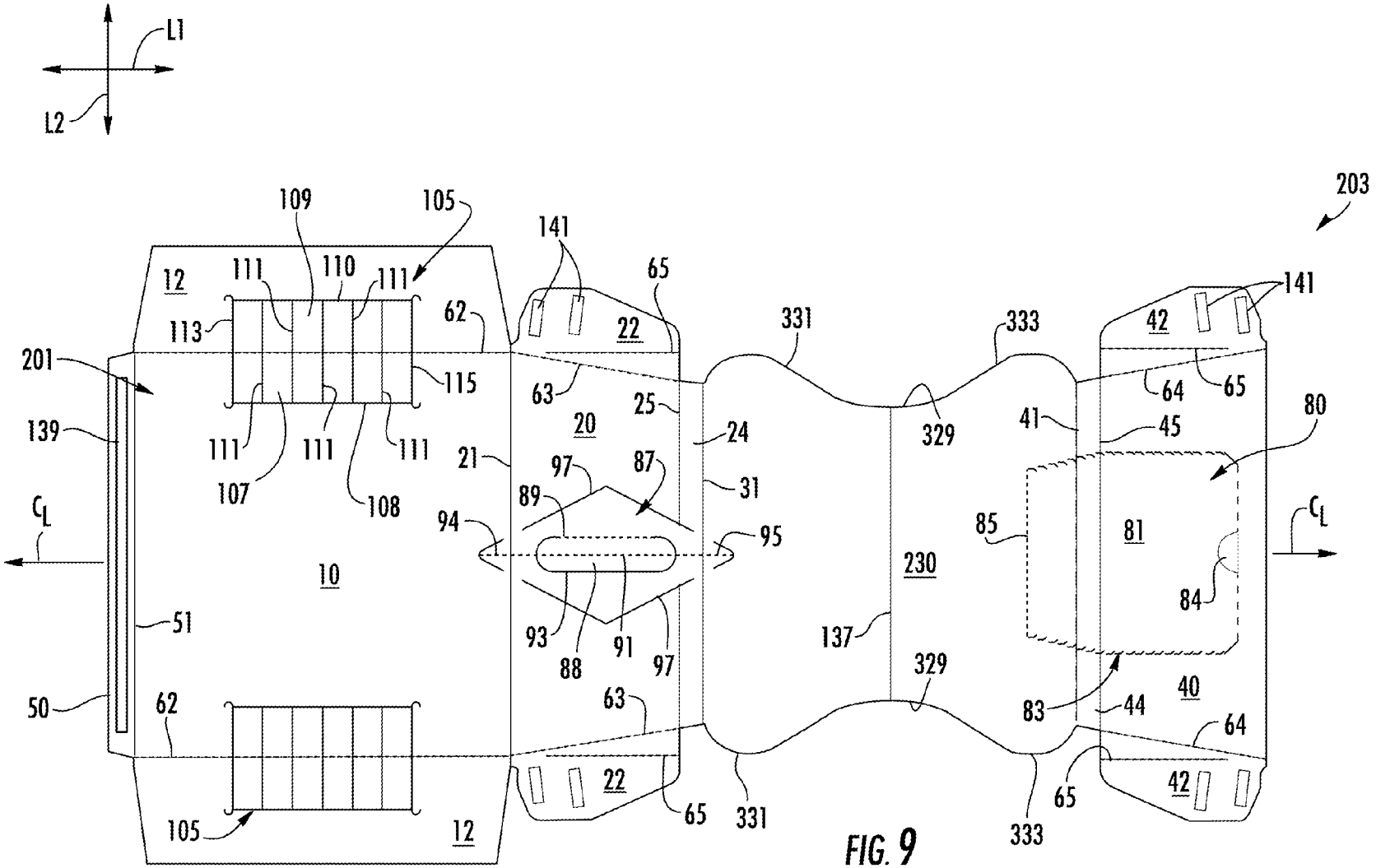
FIG. 9 is an exterior plan view of a blank used to form a carton (not shown) according to an alternative embodiment.

FIG. 9 is a plan view of an exterior surface 201 of a blank 203 for forming a carton (not shown) according to an alternative embodiment of the disclosure. The alternative embodiment is generally similar to the first embodiment, except for variations noted and variations that will be apparent to one of ordinary skill in the art. Accordingly, similar or identical features of the embodiments have been given like or similar reference numbers. As shown in FIG. 9, the blank 203 includes an alternative top panel 230 wherein the end flaps 125 are omitted. Accordingly, the top panel 230 includes a concave edge 329 extending between two convex edges 331, 333 at each end. In one embodiment, the top panel 230 has free edges at each of the ends of the carton formed from the blank 203, wherein the free edges are free from connection to a top end flap, a handle flap, and/or other features. The top panel 230 and/or the edges 329, 331, 333 could be otherwise shaped, arranged, positioned, and/or configured, or could be omitted, without departing from the disclosure.

The blanks according to any of the embodiments of the present disclosure can be, for example, formed from coated paperboard and similar materials. For example, the interior and/or exterior sides of the blank can be coated with a clay coating. The clay coating may then be printed over with product, advertising, price coding, and other information or images. The blank may then be coated with a varnish to protect any information printed on the blank. The blank may also be coated with, for example, a moisture barrier layer, on either or both sides of the blank. In accordance with the above-described embodiments, the blank may be constructed of paperboard of a caliper such that it is heavier and more rigid than ordinary paper. The blank can also be constructed of other materials, such as cardboard, hard paper, or any other material having properties suitable for enabling the carton to function at least generally as described herein. The blank can also be laminated or coated with one or more sheet-like materials at selected panels or panel sections.

In accordance with the above-described embodiments of the present disclosure, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various exemplary embodiments. Various additions, modifications, changes, etc., could be made to the exemplary embodiments without departing from the spirit and scope of the disclosure. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carton for containing a plurality of articles, the carton comprising:

a plurality of panels that extends at least partially around an interior of the carton, the plurality of panels comprising at least a bottom panel, a first side panel foldably connected to the bottom panel, a top panel foldably connected to the first side panel, and a second side panel foldably connected to the top panel; and a plurality of end flaps comprising at least a bottom end flap foldably attached to the bottom panel, a first side end flap foldably connected to the first side panel, and a second side end flap foldably connected to the second side panel, the end flaps of the plurality of end flaps at least partially overlapping one another at an end of the carton, the end having an opening adjacent the bottom end flap;

wherein the plurality of articles is for being disposed in the interior of the carton so that a void is formed in the interior between at least one article of the plurality of articles and at least a portion of the bottom end flap at the end.

2. The carton of claim 1, wherein the opening extends at least partially between the bottom end flap and the top panel.

3. The carton of claim 2, further comprising a handle adjacent the opening, the handle comprising a handle flap foldably connected to the top panel, wherein the handle flap is for being folded with respect to the top panel and disposed between the top panel and the at least one article.

4. The carton of claim 3, wherein the handle flap is foldably connected to the top panel along a curved fold line that is generally concave with respect to the end of the carton.

5. The carton of claim 4, wherein the articles of the plurality of articles are for being arranged in a plurality of rows comprising at least a first row and a second row, the first row comprises at least one more article than the second row, the second row is nested with the first row, and at least a portion of the handle is for at least partially extending over the second row.

6. The carton of claim 5, wherein the top panel comprises a curved edge adjacent the handle, the curved edge is generally convex with respect to the end of the carton, and the curved edge is for extending adjacent an end article of the first row, the end article for being disposed adjacent the bottom end flap.

7. The carton of claim 5, wherein the plurality of rows further comprises a third row and a fourth row, the third row comprises at least one more article than the fourth row, the fourth row is nested with the third row, and at least a portion of the handle is for being at least partially extending over the fourth row.

8. The carton of claim 7, wherein the top panel comprises two curved edges, each being generally convex with respect to the end of the carton, the handle flap is disposed between the two curved edges, and each curved edge of the two curved edges is for extending adjacent an end article of the respective first row and third row.

9. The carton of claim 1, further comprising a handle extending in at least the bottom end flap and the bottom panel adjacent the void.

10. The carton of claim 9, wherein the handle comprises a first handle panel foldably connected to the bottom panel and a second handle panel foldably connected to the first handle panel and foldably connected to the bottom end flap.

11. The carton of claim 10, wherein the at least one article is spaced apart from the bottom end flap by a distance, and the second handle panel has a width that is approximately equal to the distance.

12. The carton of claim 10, wherein the first handle panel and the second handle panel extend at least partially into the void so that the handle at least partially forms a corner void in the bottom panel and the bottom end flap for grasping the handle.

13. The carton of claim 12, wherein the first handle panel extends into the interior of the carton and is substantially perpendicular to the bottom panel and substantially parallel to the bottom end flap, and the second handle panel extends into the interior of the carton and is substantially perpendicular to the bottom end flap and substantially parallel to the bottom panel.

14. The carton of claim 10, wherein the first handle panel and the second handle panel are at least partially separable from the bottom panel along a line of weakening.

15. The carton of claim 9, wherein the articles of the plurality of articles are for being arranged in a plurality of rows comprising at least a first row and a second row, the first row comprises at least one more article than the second row, the second row is nested with the first row, and at least a portion of the handle is for at least partially extending adjacent the second row.

16. The carton of claim 15, wherein the at least one article is disposed at an end of the second row so that the second row is for being spaced apart from the bottom end flap at the void, and at least a portion of the handle is for being disposed in the void adjacent the at least one article.

17. The carton of claim 9, wherein the handle is a lower handle, and the carton further comprises an upper handle comprising a handle flap foldably connected to the top panel adjacent the opening.

18. The carton of claim 1, wherein the bottom end flap at least partially overlaps the first side end flap and the second side end flap at the end of the carton to partially close the end adjacent the opening.

19. The carton of claim 1, wherein the articles of the plurality of articles are for being arranged in a plurality of rows comprising at least a first row and a second row, the first row comprises at least one more article than the second row, the second row is nested with the first row, and the side end flap is for at least partially engaging an article at an end of the first row.

20. A carton for containing a plurality of articles, the carton comprising:

a plurality of panels that extends at least partially around an interior of the carton, the plurality of panels comprising at least a top panel, and a side panel;

at least one end flap comprising at least a bottom end flap foldably attached to the bottom panel at an end of the carton, the end having an opening adjacent the bottom end flap, wherein the plurality of articles is for being disposed in the interior of the carton so that a void is formed in the interior between at least one article of the plurality of articles and at least a portion of the bottom end flap at the end; and a handle extending in at least the bottom end flap and the bottom panel adjacent the void, the handle comprising a first handle panel foldably connected to the bottom panel and a second handle panel foldably connected to the first handle panel and foldably connected to the bottom end flap;

wherein the first handle panel is foldably connected to the bottom panel along a first fold line, the second handle panel is foldably connected to the bottom end flap along a second fold line, and the handle comprises a plurality of lateral fold lines each extending from the first fold line to the second fold line.

21. A blank for forming a carton for containing a plurality of articles, the blank comprising:

a plurality of panels comprising at least a bottom panel, a first side panel foldably connected to the bottom panel, a top panel foldably connected to the first side panel, and a second side panel foldably connected to the top panel; and a plurality of end flaps comprising at least a bottom end flap foldably attached to the bottom panel, a first side end flap foldably connected to the first side panel, and a second side end flap foldably connected to the second side panel, the end flaps of the plurality of end flaps being for at least partially overlapping one another at an end of the carton formed from the blank, the end being for having an opening adjacent the bottom end flap when the carton is formed from the blank;

wherein the plurality of articles is for being disposed in the interior of the carton formed from the blank for forming a void in the interior between at least one article of the plurality of articles and at least a portion of the bottom end flap at the end when the carton is formed from the blank.

22. The blank of claim 21, further comprising handle features for forming a handle for being disposed adjacent the opening, the handle features comprising a handle flap foldably connected to the top panel.

23. The blank of claim 22, wherein the handle flap is foldably connected to the top panel along a curved fold line that is generally concave.

24. The blank of claim 23, wherein the articles of the plurality of articles are for being arranged in a plurality of rows comprising at least a first row and a second row, the first row comprises at least one more article than the second row, the second row is nested with the first row, and at least a portion of the handle is for at least partially extending over the second row when the carton is formed from the blank.

25. The blank of claim 24, wherein the top panel comprises a curved edge adjacent the handle features, and the curved edge is a generally convex curve.

26. The blank of claim 25, wherein the curved edge extends from an end of the curved fold line.

27. The blank of claim 25, wherein the handle flap does not extend beyond the curved edge in a direction generally perpendicular to a longitudinal centerline of the blank.

28. The blank of claim 23, wherein the top panel comprises two curved edges, each being a generally convex curve and extending from a respective end of the curved fold line.

29. The blank of claim 28, wherein the handle flap does not extend beyond the curved edge in a direction generally perpendicular to a longitudinal centerline of the blank.

30. The blank of claim 21, wherein the top panel comprises a free edge for extending along the end of the carton formed from the blank.

31. The blank of claim 30, wherein the free edge is for at least partially defining the opening in the end when the carton is formed from the blank.

32. The blank of claim 30, wherein the top panel is free from connection to an end flap of the plurality of end flaps.

33. The blank of claim 21, further comprising handle features for forming a handle, the handle features extending in at least the bottom end flap and the bottom panel.

34. The blank of claim 33, wherein the handle features comprise a first handle panel foldably connected to the bottom panel and a second handle panel foldably connected to the first handle panel and foldably connected to the bottom end flap.

35. The blank of claim 34, wherein the first handle panel is foldably connected to the bottom panel along a fold line, the second handle panel is foldably connected to the first handle panel by a second fold line, the at least one article is for being spaced apart from the bottom end flap by a distance when the carton is formed from the blank, and the first fold line is spaced from the second fold line by approximately the distance.

36. The blank of claim 34, wherein the first handle panel and the second handle panel are at least partially separable from the bottom panel along a line of weakening.

37. The blank of claim 33, wherein the handle features are lower handle features, and the carton further comprises upper handle features for forming an upper handle adjacent the opening when the carton is formed from the blank, the upper handle features comprising a handle flap foldably connected to the top panel.

38. The blank of claim 21, wherein the bottom end flap is for at least partially overlapping the first side end flap and the second side end flap at the end of the carton to partially close the end adjacent the opening when the carton is formed from the blank.

39. A blank for forming a carton for containing a plurality of articles, the blank comprising:

a plurality of panels comprising at least a bottom panel, a top panel, and a side panel;

at least one end flap comprising at least a bottom end flap foldably attached to the bottom panel, the bottom end flap being for at least partially forming an end of the carton formed from the blank, the end being for having an opening adjacent the bottom end flap when the carton is formed from the blank; and handle features for forming a handle, the handle features extending in at least the bottom end flap and the bottom panel, the handle features comprising a first handle panel foldably connected to the bottom panel and a second handle panel foldably connected to the first handle panel and foldably connected to the bottom end flap;

wherein the first handle panel is foldably connected to the bottom panel along a first fold line, the second handle panel is foldably connected to the bottom end flap along a second fold line, and the handle comprises a plurality of lateral fold lines each extending from the first fold line to the second fold line;

wherein the plurality of articles is for being disposed in the interior of the carton formed from the blank for forming a void in the interior between at least one article of the plurality of articles and at least a portion of the bottom end flap at the end when the carton is formed from the blank.

40. A method of forming a package comprising a carton holding a plurality of articles, the method comprising:

obtaining a blank comprising a plurality of panels and at least one end flap, the plurality of panels comprising at least a bottom panel, a top panel, and a side panel, and the at least one end flap comprising at least a bottom end flap foldably attached to the bottom panel;

forming an interior of the carton at least partially defined by the plurality of panels so that the top panel, the side panel, and the bottom panel at least partially form an open-ended sleeve;

disposing the plurality of articles at least partially in the interior of the carton; and positioning the at least one end flap to partially close an end of the carton, the end having an opening adjacent the bottom end flap, wherein the disposing the plurality of articles comprises positioning at least one article of the plurality of articles so that a void is formed between the at least one article and the bottom end flap at the end of the carton after the positioning the at least one end flap.

41. The method of claim 40, wherein the carton comprises a handle comprising a handle flap foldably connected to the top panel adjacent the opening.

42. The method of claim 41, further comprising folding the handle flap into face-to-face contact with the top panel so that the handle flap extends at least partially between the top panel and the at least one article.

43. The method of claim 41, wherein the handle flap is foldably connected to the top panel along a curved fold line, and the top panel comprises a curved edge extending from an end of the curved fold line, the curved fold line being concave and the curved edge being convex.

44. The method of claim 40, wherein the blank further comprises handle features extending in at least the bottom end flap and the bottom panel, the method further comprising forming a handle by positioning at least a portion of the handle features at least partially into the void.

45. The method of claim 44, wherein the handle features comprise a first handle panel foldably connected to the bottom panel and a second handle panel foldably connected to the first handle panel and foldably connected to the bottom end flap, the forming the handle comprising folding the first handle panel and the second handle panel into the interior of the carton with respect to the bottom panel and the bottom end flap.

46. The method of claim 45, wherein the first handle panel and the second handle panel are at least partially defined by a line of weakening, the forming the handle comprising separating the first handle panel and the second handle panel from the respective bottom panel and bottom end flap along the line of weakening.

47. The method of claim 45, wherein the disposing the plurality of articles comprising arranging the articles of the plurality of articles in a plurality of rows comprising at least a first row and a second row, the first row comprises at least one more article than the second row, the second row is nested with the first row, the at least one article is disposed at an end of the second row, and the forming the handle further comprises positioning the second handle panel to extend from the bottom end flap to the at least one article in the void and positioning the first handle panel to extend adjacent the at least one article.

48. The method of claim 45, wherein the forming the handle comprises forming a corner void in the bottom panel and the bottom end flap for grasping the handle.

49. The method of claim 40, wherein the positioning the at least one end flap comprises positioning the bottom end flap to be spaced apart from the top panel to form the opening between a free edge of the bottom end flap and a free edge of the top panel.

* * * * *